US007067011B2

(12) United States Patent
Inoue et al.

(10) Patent No.: US 7,067,011 B2
(45) Date of Patent: *Jun. 27, 2006

(54) APPARATUS AND METHOD FOR DISCHARGE SURFACE TREATMENT

(75) Inventors: Tooru Inoue, San Diego, CA (US); Akihiro Goto, Tokyo (JP)

(73) Assignee: Mitsubushi Denki Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/898,992

(22) Filed: Jul. 27, 2004

(65) Prior Publication Data

US 2005/0079276 A1 Apr. 14, 2005

Related U.S. Application Data

(60) Continuation-in-part of application No. 10/694,170, filed on Oct. 28, 2003, now Pat. No. 6,783,795, which is a division of application No. 09/660,417, filed on Sep. 12, 2000, now Pat. No. 6,702,896, which is a continuation of application No. PCT/JP98/02042, filed on May 8, 1998.

(51) Int. Cl.
*B05C 5/053* (2006.01)
*B05C 5/10* (2006.01)

(52) U.S. Cl. ..... 118/638; 118/620; 323/208; 323/209; 323/210; 323/211; 323/277; 320/166; 320/167

(58) Field of Classification Search ..... 323/208, 323/209, 210, 211, 277; 118/620, 638; 320/166, 320/167; 427/580, 530, 8, 59, 540; 219/69.17, 219/69.18, 69.19
See application file for complete search history.

(56) References Cited

U.S. PATENT DOCUMENTS

| | | | | |
|---|---|---|---|---|
| 3,655,936 | A | 4/1972 | Saito et al. | |
| 5,179,511 | A | 1/1993 | Troyk et al. | |
| 5,240,584 | A | 8/1993 | Szcyrbowski et al. | |
| 5,286,360 | A | 2/1994 | Szcyrbowski et al. | |
| 5,380,975 | A | 1/1995 | Sato et al. | |
| 6,020,723 | A | 2/2000 | Desor et al. | |
| 6,086,684 | A | 7/2000 | Saito et al. | |
| 6,702,896 | B1 * | 3/2004 | Inoue et al. | 118/638 |

FOREIGN PATENT DOCUMENTS

| | | |
|---|---|---|
| DE | 21-04-627 C3 | 8/1971 |
| DE | 42-43-992 C2 | 7/1993 |

(Continued)

OTHER PUBLICATIONS

Horowitz and Hill, The Art of Electronics, 1995, Cambridge University Press, 2nd Edition, 44-45, 368-389.*

(Continued)

*Primary Examiner*—George Koch
(74) *Attorney, Agent, or Firm*—Sughrue Mion, PLLC

(57) ABSTRACT

An apparatus has a green compact electrode including a material of a coating formed on a workpiece by a discharge, a power source for supplying a first voltage, a voltage detector for detecting a voltage between the workpiece and the electrode, and a pulse current generator for generating and outputting a pulse current from the first voltage, and for cutting off the output when a predetermined period of time has passed after the voltage is detected to be less than a detection voltage. The pulse current is supplied between the workpiece and the electrode, and the detection voltage is less than the first voltage by 5% to 20% of the first voltage.

10 Claims, 9 Drawing Sheets

FOREIGN PATENT DOCUMENTS

| | | | |
|---|---|---|---|
| JP | 54-153743 | A | 12/1979 |
| JP | 63-33580 | A | 2/1988 |
| JP | 04-189419 | A | 7/1992 |
| JP | 6-247791 | A | 9/1994 |
| JP | 7-62521 | A | 3/1995 |
| JP | 7-197275 | A | 8/1995 |

OTHER PUBLICATIONS

Official Action, German Patent and Trademark Office.

* cited by examiner

APPARATUS AND METHOD FOR DISCHARGE SURFACE TREATMENT

CROSS-REFERENCE TO RELATED APPLICATIONS

This application is a continuation-in-part of application Ser. No. 10/694,170 filed Oct. 28, 2003 now U.S. Pat. No. 6,783,795, which is a divisional of application Ser. No. 09/660,417 filed Sep. 12, 2000, now U.S. Pat. No. 6,702,896, which is a continuation of PCT/JP98/02042, with an international filing date of May 8, 1998, designating the United States. Priority of the above-mentioned applications is claimed and each of the above-mentioned applications are hereby incorporated by reference in their entirety.

BACKGROUND OF THE INVENTION

1) Field of the Invention

The present invention relates to an apparatus and a method for discharge surface treatment. More specifically, this invention relates to the power supply apparatus for discharge surface treatment which uses a green compact electrode as a discharge electrode, and allows a pulse-type discharge to take place between the discharge electrode and a workpiece so as to form a film, which film is made of an electrode material or a material obtained when the electrode material reacts to the discharge energy, on a surface of the workpiece.

2) Description of the Related Art

FIG. 7 shows a prior discharge coating apparatus disclosed in Japanese Patent Application Laid-Open No. 54-153743. The discharge coating apparatus has a working tank 1 for housing working fluid, an electrode (covered electrode) 2 which is arranged so as to face a workpiece W in the working tank 1 with a predetermined discharge gap therebetween. A power supply apparatus (pulse power supply apparatus) 3 applies a pulse-like voltage to between the workpiece W and the electrode 2.

When the pulse-like voltage is applied to between the electrode 2 and the workpiece W, the discharge surface treatment by means of the discharge coating apparatus allows pulse-type discharge to take place between the electrode 2 and the workpiece W. As a result, a film made of the material of the electrode 2 or a material obtained when the material of the electrode reacts to the discharge energy is formed on the surface of the workpiece W.

The power supply apparatus 3 has a DC power supply 4, an oscillator 5 which generates a pulse current of a predetermined frequency by giving a DC current to the oscillator 5 from the DC power supply 4, electric current cut-off means 6 such as a thyristor, and voltage detection means 7 which detects a discharge voltage between the workpiece W and the working electrode 2.

A comparator 8 compares the discharge voltage detected by the voltage detection means 7 with a discharge detection voltage (threshold value Vth) set by a discharge detection voltage setting unit 9. The comparator 8 outputs a forced electric current cut-off command to the electric current cut-off means 6 after constant time .DELTA.t passes from the point of time that the discharge voltage (voltage detected value V) becomes lower than the set value Vth of the discharge detection voltage. The electric current cut-off means 6 forcibly ends the discharge according to the forced electric current cut-off command.

In the discharge coating apparatus having the above structure, the oscillator 5 applies a voltage to between the workpiece W and the electrode 2 that have a predetermined gap therebetween. When the gap between the workpiece W and the electrode 2 attains a predetermined value, discharge takes place between the workpiece W and the electrode 2. The workpiece W is worked by the discharge energy.

When the discharge starts, the inter-electrode voltage abruptly drops at the point of time shown by a point A in FIG. 8. The voltage detection means 7 detects such a drop in the voltage, and after the constant time .DELTA.t passes from the starting of the discharge, the electric current cut-off means 6 cuts off the output of the oscillator 5 so that the discharge is forcibly terminated. After the discharge current completely fails, voltage is again applied to between the workpiece W and the electrode 2 by the output of the oscillator 5.

As a result, long-time pulse is not obtained, and the voltage is cut off at suitable discharge time. Therefore, occurrence of a layer having different properties on the surface of the workpiece is avoided, and a satisfactorily worked surface can be obtained.

At the time of the discharge working, since discharge tailing which generates between the workpiece W and the electrode 2 during the working floats, and thus the resistance between the electrodes is lowered. As a result, the inter-electrode voltage at the time of discharge is also lowered. For this reason, when the set value Vth of the discharge detection voltage is set to a higher value, it is difficult to detect the discharge normally. Therefore, the set value Vth of the discharge detection voltage should be set to a comparatively low value as shown in FIG. 8.

When a green compact electrode obtained by compression-molding metallic powder or metallic compound into an electrode shape is used in the discharge surface treatment, the electrical resistance of the electrode is considerably higher than that of a normal copper electrode. As shown in FIG. 7, the voltage detection means 7 which is connected with a circuit reads also a part of the voltage which drops because of the electrical resistance of the working electrode 2. The characteristic of the voltage detected by the voltage detection means 7 is as shown in FIG. 9, and the detected voltage does not drop sufficiently even after the discharge has terminated so that the discharge cannot be detected.

As a result, the output of the oscillator cannot be cut off suitably, and the discharge with long-time pulse is generated so that it is difficult to maintain the suitable discharge state.

The present invention is devised in order to solve the above problems, and it is an object of the invention to provide a power supply apparatus which cuts off a voltage at suitable discharge time and prevents long-time pulse discharge in a discharge surface treatment using a green compact electrode.

SUMMARY OF THE INVENTION

The present invention can provide a power supply apparatus for discharge surface treatment which uses a green compact electrode as a discharge electrode, allows pulse-type discharge to take place between the discharge electrode and a workpiece, and forms a film, which is made of an electrode material or a material obtained when the electrode material reacts to the discharge energy, on a surface of the workpiece, including: an oscillator which generates a pulse current of a predetermined frequency when an electric current from a power source is applied thereto; electric current cut-off means which cuts off an output of the oscillator; and voltage detection means which detects a discharge voltage between the workpiece and a working electrode, wherein when the discharge voltage detected by the voltage detection means obtains not more than discharge detection voltage set value, the electric current cut-off means forcibly cuts off the output of the oscillator, and the discharge detection voltage set value is set to a value slightly lower than a power-supply voltage.

Therefore, in the discharge surface treatment using the green compact electrode, a voltage is cut off at suitable discharge time so that long-time pulse discharge is prevented.

In addition, the present invention can provide power supply apparatus for discharge surface treatment which uses a green compact electrode as a discharge electrode, allows pulse-type discharge to take place between the discharge electrode and a workpiece, and forms a film, which is made of an electrode material or a material obtained when the electrode material reacts to the discharge energy, on a surface of the workpiece, characterized by including: an oscillator which generates a pulse current of a predetermined frequency when an electric current is given from a power supply thereto, wherein a capacitor is connected with an oscillation circuit of the oscillator in parallel.

Therefore, in the discharge surface treatment using the green compact electrode, the discharge is ended with capacitor discharge which is determined by capacitance of the capacitor, and long-time pulse discharge is prevented in the discharge surface treatment using the green compact electrode.

Further, the present invention can provide a power supply apparatus for discharge surface treatment, wherein a reactance is connected with the oscillation circuit in a series.

Therefore, the discharge current can be distorted, the discharge current can be controlled so as to have the suitable waveform for the discharge surface treatment.

Further, the present invention can provide a power supply apparatus for discharge surface treatment which uses a green compact electrode as a discharge electrode, allows pulse-type discharge to take place between the discharge electrode and a workpiece, and forms a film, which is made of an electrode material or a material obtained when the electrode material reacts to the discharge energy, on a surface of the workpiece, including: an oscillator which generates a pulse current of a predetermined frequency when an electric current is given from a power supply thereto; electric current cut-off means which cuts off an output of the oscillator; and timer means, wherein the electric current cut-off means forcibly cuts off the output of the oscillator per constant time which is counted by the timer means.

Thus, the duration of time for which the discharge takes place once is controlled by the timer. Therefore, long-time pulse discharge is prevented in the discharge surface treatment using the green compact electrode.

An apparatus for discharge surface treatment according to another aspect of the present invention includes: a green compact electrode as a discharge electrode including a material of a coating formed on a surface of a workpiece by a discharge generated between the discharge electrode and the workpiece; a first power source configured to supply a first voltage; a voltage detector configured to detect a voltage between the workpiece and the discharge electrode; and a pulse current generator configured to generate and output a pulse current from the first voltage, and to cut off the output when a predetermined period of time has passed after the voltage detector detects the voltage to be less than a discharge detection voltage, wherein the pulse current output by the pulse current generator is supplied between the workpiece and the discharge electrode, and the discharge detection voltage is a value less than the first voltage by 5% to 20% of the first voltage.

A method of discharge surface treatment according to still another aspect of the present invention includes placing a green compact electrode, formed of compressed powder, as a discharge electrode including a material of a coating formed on a surface of a workpiece by a discharge generated between the discharge electrode and the workpiece; supplying a first voltage; detecting a voltage between the workpiece and the discharge electrode; generating and outputting a pulse current from the first voltage; and cutting off the output when a predetermined period of time has passed after the voltage is detected to be less than a discharge detection voltage, wherein the pulse current output is supplied between the workpiece and the discharge electrode, and the discharge detection voltage is a value less than the first voltage by 5% to 20% of the first voltage.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 4(*b*) is a graph showing an inter-electrode current characteristic in the second embodiment;

DETAILED DESCRIPTION

There will be explained below preferred embodiments of the present invention with reference to the attached drawings. In the preferred embodiments of the present invention explained below, same legends have been provided to parts of a structure which are the same as those of the prior structure, and the explanation thereof is omitted.

First Embodiment

Figure 1:
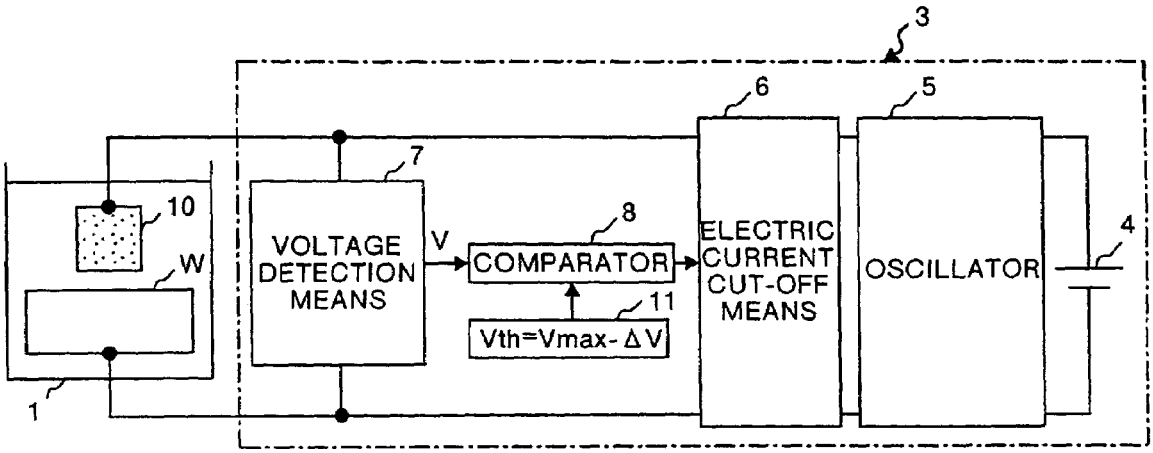
FIG. 1 is a block diagram showing a power supply apparatus for discharge surface treatment according to a first embodiment of the present invention.

FIG. 1 shows a power supply apparatus for discharge surface treatment of the present invention.

The discharge electrode (electrode for machining) 10 is a green compact electrode which is obtained by compression-molding metallic powder or metallic compound into an electrode shape.

Figure 2:
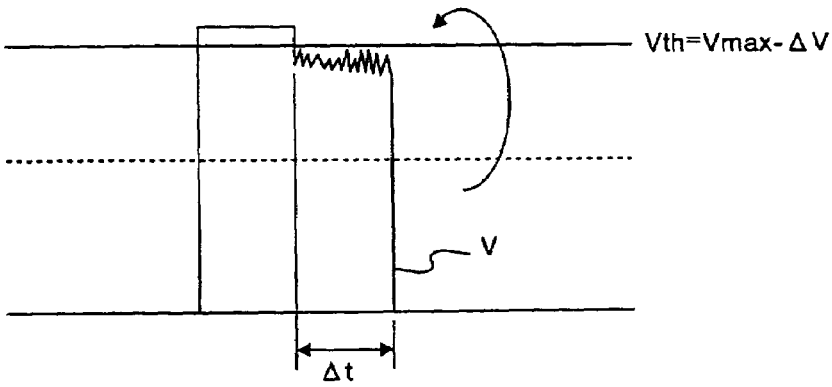
FIG. 2 is a graph showing inter-electrode voltage characteristic and a discharge detection voltage set value in the first embodiment.

The discharge detection voltage set unit 11 sets, as shown in FIG. 2, a discharge detection voltage set value Vth to a value Vmax−.DELTA.V which is slightly lower than a discharge supply voltage Vmax. Here, .DELTA.V is about 5 to 20% of Vmax.

In this power supply apparatus 3, when a discharge voltage V which detected by the voltage detection means 7 is less than or equal to the discharge detection voltage set value Vth which is equal to Vmax−.DELTA.V, that is a value which is slightly lower than the power-supply voltage Vmax, then the output of the oscillator 5 is forcibly cut off by the electric current cut-off means 6 after elapse of a predetermined time .DELTA.t.

As a result, in the discharge surface treatment using the green compact electrode, the voltage is cut off at suitable discharge time, and long-time pulse discharge is prevented.

In the discharge surface treatment, since discharge tailing is not generated between the electrodes, a voltage in a no-load state does not drop. For this reason, when the discharge detection voltage is set to a value slightly lower than the power-supply voltage, the discharge can be detected normally even if the voltage value during the discharge is high.

Figure 10:
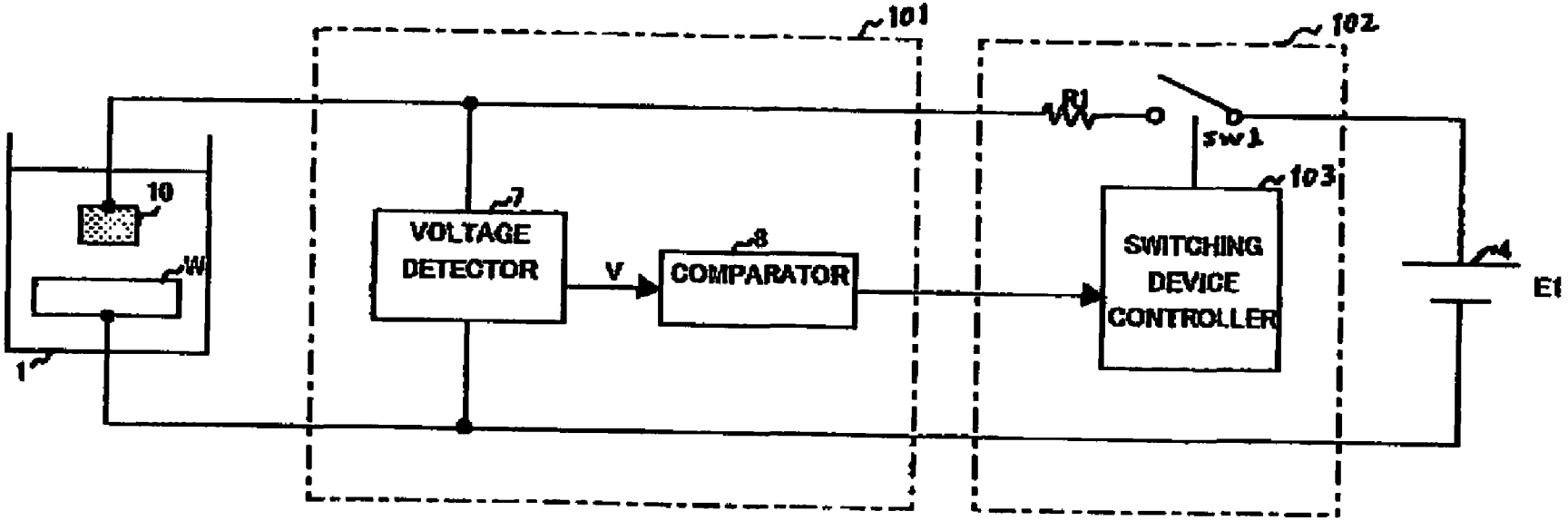
FIG. 10 is a block diagram of a specific example of a circuit configuration according to the first embodiment.

FIG. 10 is a block diagram of one of the simplest specific examples of a circuit configuration of the discharge surface treatment apparatus illustrated in FIG. 1. A pulsed current generator 102, which includes a resistor R1, a switching element SW1 such as a field effect transistor, and a switching element controller 103 in FIG. 10, is substantially equivalent to the combination of the oscillator 5 and the electric current cut-off means 6 in FIG. 1.

The switching element controller 103 is configured to switch ON/OFF the switching element SW1. When the switching element SW1 is switched on by the switching element controller 103, a voltage is applied between the electrode 10 and the workpiece W by the DC power supply 4.

A discharge then subsequently occurs between the electrode 10 and the workpiece W after a predetermined period of time, causing a voltage drop between the electrode 10 and the workpiece W. The voltage and the voltage drop are detected by the voltage detection means 7. The comparator 8 compares the voltage detected with the discharge detection voltage Vth, and if the voltage is less than the discharge detection voltage Vth, it is detected that the discharge has occurred. That is, the voltage detection means 7 and the comparator 8 function together as a discharge detector 101. The discharge detector 101 outputs a discharge detection signal to the switching element controller 103 as the discharge detector 101 detects that the discharge has occurred. The switching element controller 103 turns the switching element SW1 OFF so as to stop the discharge when a predetermined period of time has passed after the switching element controller 103 receives the discharge detection signal.

A voltage Vvd detected by the voltage detection means 7 is equivalent to a sum of a potential Vg of an ark column generated at the time of discharge between the electrode 10 and the workpiece W, and the voltage drop caused by a resistance Re of the electrode 10. The voltage Vvd can be represented by equation (1) below.

$$Vvd=Vg+Ip\times Re=Vg+(E1-Vg)\times Re/(R1+R2) \quad (1)$$

The resistance Re of the electrode 10 is approximately between 0.1 to 10 ohms. This resistance Re is not a value obtained by directly measuring the actual resistance of the electrode 10 but is a value found by assuming that the potential Vg of the ark column is approximately 25 V and measuring the voltage Vvd.

If, for example, a supply voltage E1 of the DC power supply 4 is 100 V, a resistance of the resistor R1 is 10 ohms, and a potential Vg of the ark column between the electrode 10 and the workpiece W is 25 V, a peak value Ip of a discharge pulse current is represented by equation (2) below and found to be approximately 7 A.

$$Ip=(E1-Vg)/(R1+Re) \quad (2)$$

A polarity of the electrode 10 may be positive or negative. Although the polarity is illustrated to be positive in FIG. 10, a strong coating may be also formed when the polarity is negative.

Second Embodiment

Figure 3:
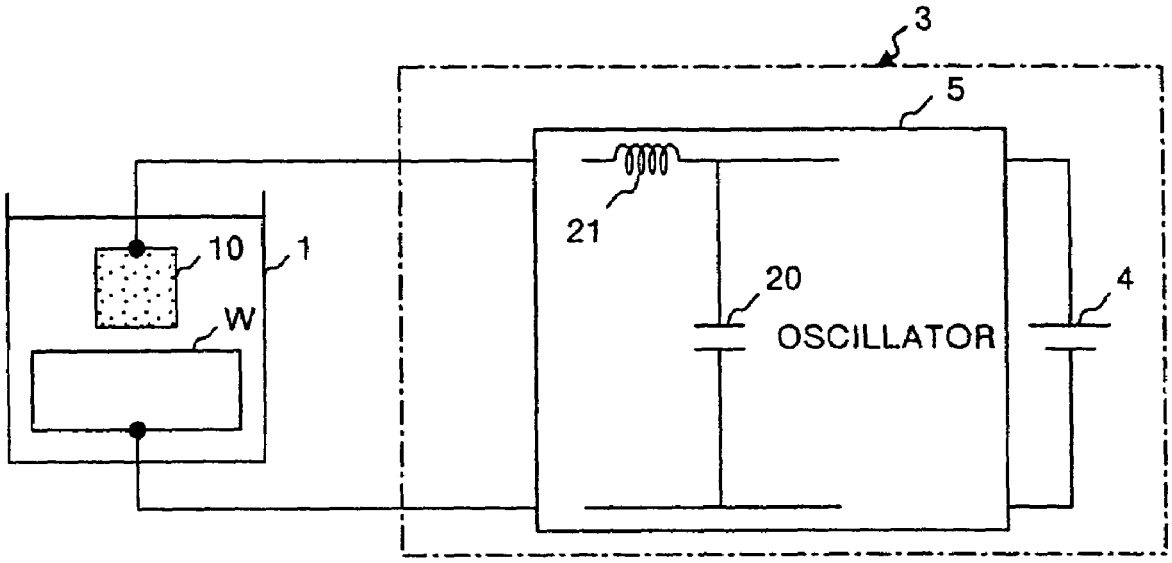
FIG. 3 is a block diagram showing the power supply apparatus for discharge surface treatment according to a second embodiment of the present invention.

FIG. 3 shows the power supply apparatus for discharge surface treatment of the present invention.

A capacitor 20 is connected with an oscillation circuit of the oscillator 5 in parallel, and a reactance 21 is connected with the oscillation circuit in a series.

The oscillation circuit of the oscillator 5 applies a voltage to between the discharge electrode 10 and the workpiece W. The discharge electrode 10 is a green compact electrode. Accordingly, parallel and series connection with this oscillation circuit is equivalent to that when the oscillation circuit is connected with the discharge electrode 10 and the workpiece W in parallel and in series.

An electric charge is stored in the capacitor 20 of the oscillator 5. When the amount of the electric charge stored in the capacitor 20 exceeds a specific amount, discharge takes place between the discharge electrode 10 and the workpiece W so that an electric current flows. When the electric current flows, the electric charge in the capacitor 20 is reduced and the discharge terminates.

Figure 4:
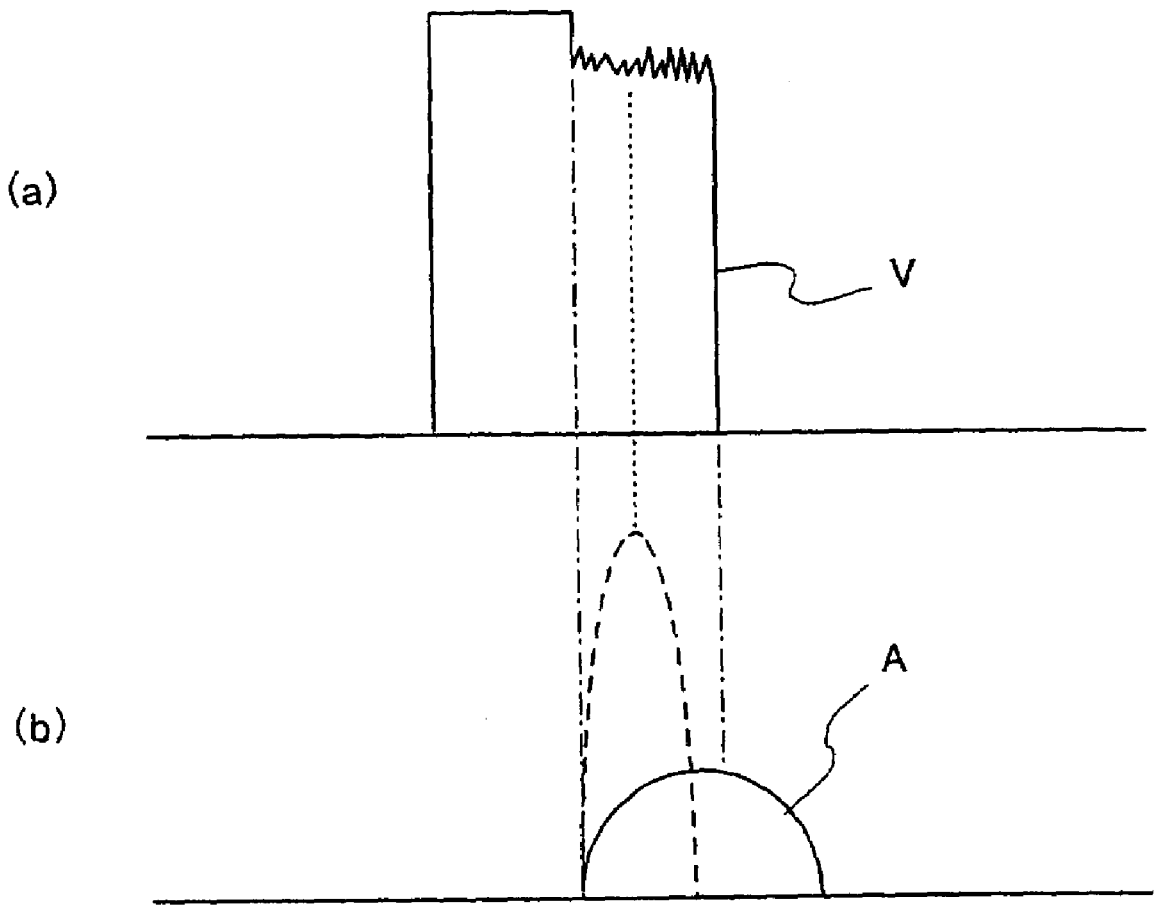
FIG. 4(*a*) is a graph showing an inter-electrode voltage characteristic in the second embodiment.

As a result, even if the discharge voltage is not detected, the normal discharge state with the inter-electrode voltage characteristic can be realized as shown in FIG. 4(*a*).

That is, the discharge terminates along with the capacitor discharge which depends upon the capacitance of the capacitor, and long-time pulse discharge is prevented in the discharge surface treatment using the green compact electrode.

However, as shown by a dotted line in FIG. 4(*b*), only with the capacitor 20, there is a possibility that the discharge current attains a high peak and ends in a short time. Therefore, sometimes a suitable electric current waveform cannot be obtained in the discharge surface treatment.

On the contrary, when the reactance 21 is inserted in a series, as shown by a solid line in FIG. 4(*b*), the discharge current can be distorted. For this reason, the value, of the capacitor 20 and the value of the reactance 21 are adjusted together so that the discharge current can be adjusted so as to have a suitable waveform for the discharge surface treatment. As a result, the suitable treated surface can be obtained.

The reactance 21 may be replaced by an internal reactance included in the circuit, and the capacitor 20 and the reactance 21 can be of changeable type.

Third Embodiment

Figure 5:
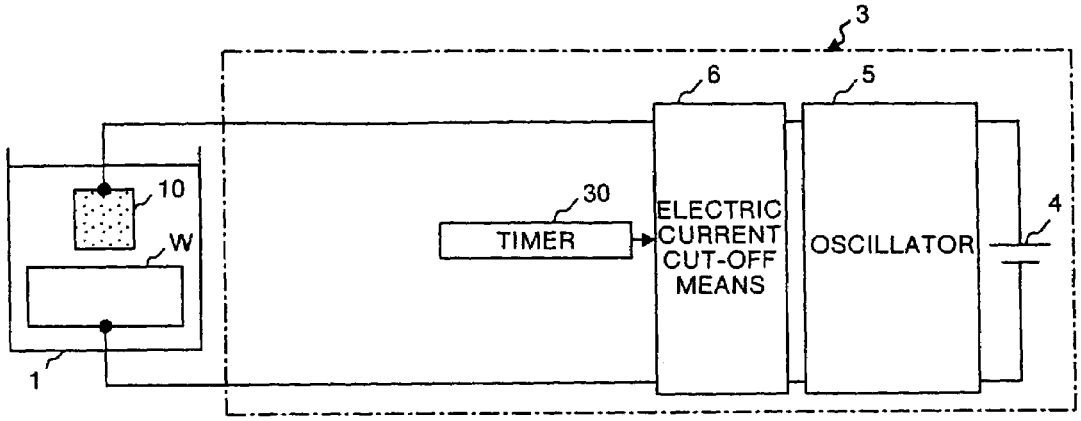
FIG. 5 is a block diagram showing the power supply apparatus for discharge surface treatment according to a third embodiment of the present invention.

FIG. 5 shows the power supply apparatus for discharge surface treatment of the present invention.

This power supply apparatus is provided with a timer means 30. This timer means 30 counts elapse of a specific time Tcon. The electric current cut-off means 6 forcibly cuts off the output of the oscillator 5 every time the timer means 30 counts that the time Tcon has elapsed.

Figure 6:
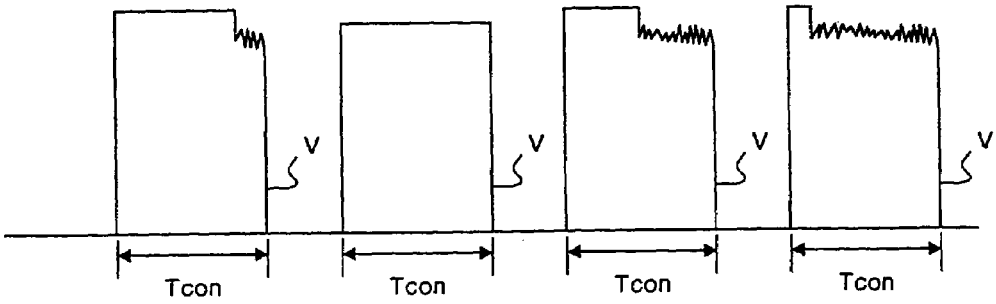
FIG. 6 is a graph showing the inter-electrode voltage characteristic in the third embodiment.
Figure 7:
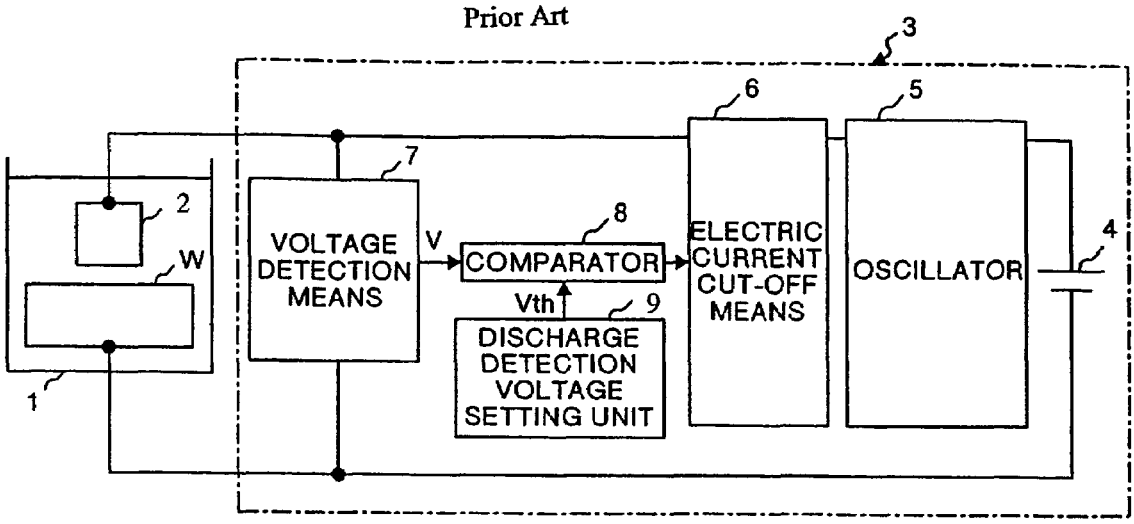
FIG.7 Prior Art
FIG. 7 is a block diagram showing a conventional discharge coating apparatus.
Figure 8:
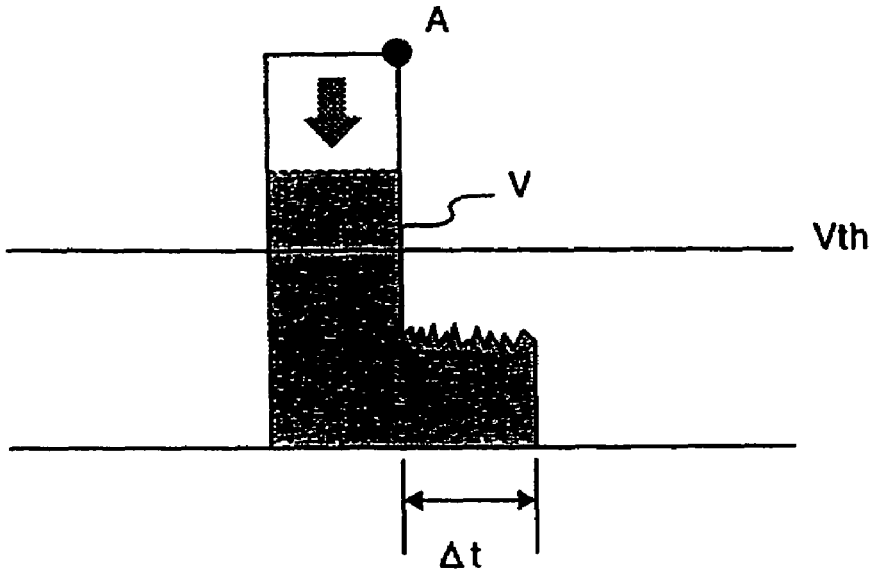
FIG.8 Prior Art
FIG. 8 is a graph showing inter-electrode voltage characteristic and a discharge detection voltage set value in the prior discharge coating apparatus.
Figure 9:
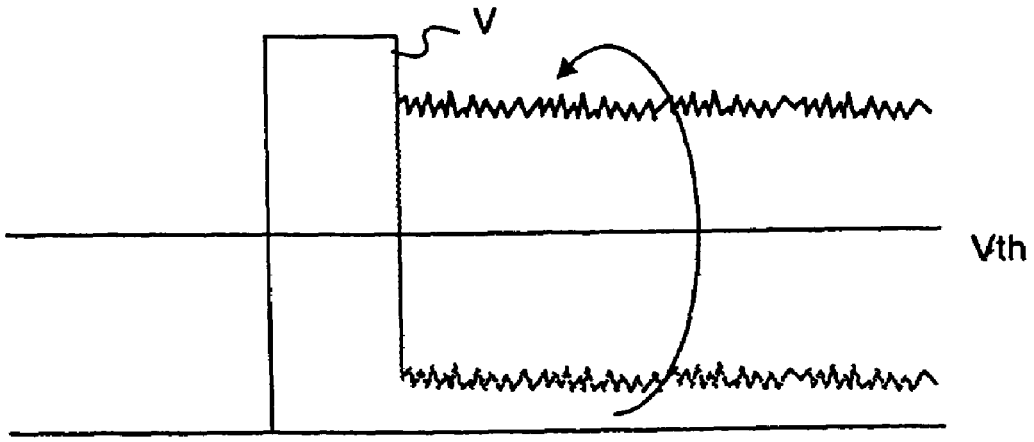
FIG.9 Prior Art
FIG. 9 is a graph showing the inter-electrode voltage characteristic and the discharge detection voltage set value in the case where a green compact electrode is used.

In this embodiment, as shown in FIG. 6, the applied voltage is cut off per constant time Tcon regardless of a discharge state, and long-time pulse can be prevented in the discharge surface treatment using the green compact electrode without detecting a discharge voltage.

As mentioned above, the power supply apparatus for discharge surface treatment of the present invention realizes the prevention of long-time pulse in the discharge surface treatment using the green compact electrode, and can be utilized as a power supply apparatus of a discharge coating apparatus which uses the green compact electrode.

Fourth Embodiment

Figure 11:
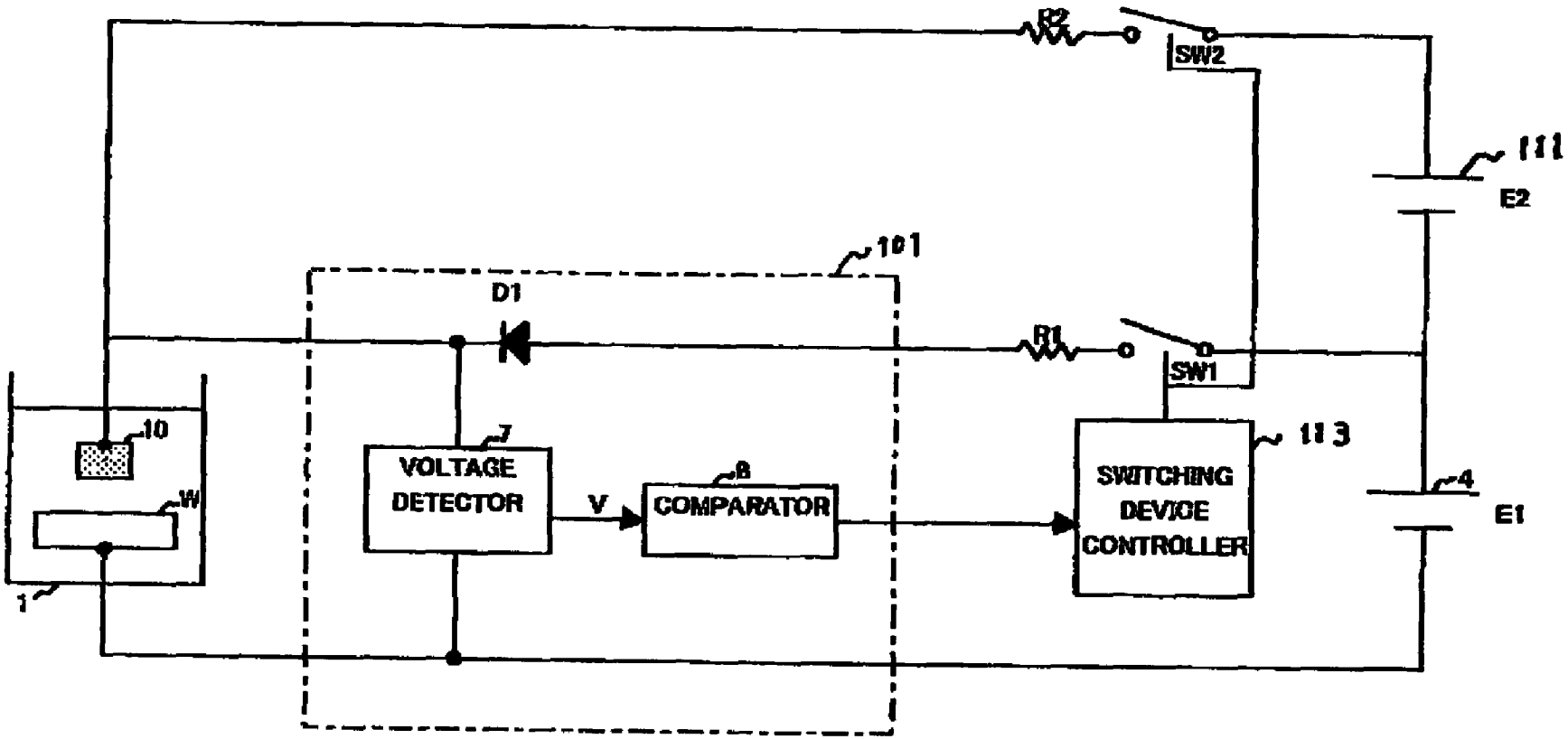
FIG. 11 is a block diagram of a fourth embodiment of a discharge surface treatment apparatus according to the present invention.

FIG. 11 is a block diagram of a fourth embodiment according to the present invention. The configuration of the fourth embodiment is basically the same as that in FIG. 10, but further includes a circuit for superposing a voltage to the voltage between the electrode 10 and the workpiece W. That is, the circuit including a DC power supply 111 which supplies a supply voltage E2, a switching element SW2, and a resistor R2 is added so as to increase the voltage between the electrode 10 and the workpiece W during an unloaded period between a point of time at which the voltage is applied between the electrode 10 and the workpiece W and a point of time at which a discharge occurs. As shown in FIG. 11, a rectifier D1 is located between the DC power supply 4 and the electrode 10. The rectifier D1 prevents backflow of the current supplied from the DC power supply 111 and ensures that the supply voltage E2 of the DC power supply 111 is applied between the electrode 10 and the workpiece W.

The configuration further includes a switching element controller 113 which is adapted to switch ON/OFF both of the switching elements SW1 and SW2. When the switching elements SW1 and SW2 are turned ON, a voltage equivalent to E1+E2 is applied between the electrode 10 and the workpiece W. After a predetermined period of time passes, a discharge occurs between the electrode 10 and the workpiece W causing a voltage drop between the electrode 10 and the workpiece W. The discharge detector 101 then detects that the discharge has occurred, similarly to the first embodiment and outputs a discharge detection signal to the switching element controller 113. The switching element controller 113 switches OFF the switching elements SW1 and SW2 so as to stop the discharge, when a predetermined period of time has passed after the switching element controller 113 receives the discharge detection signal.

The DC power supply 4 functions as a main power supply for flowing a current between the electrode 10 and the workpiece W. The DC power supply 111 functions as an auxiliary power supply for increasing the voltage between the electrode 10 and the workpiece W in the unloaded period and supplies a current smaller than that supplied by the DC power supply 4.

If, for example, the supply voltage E1 is 100 V, the resistance of the resistor R1 is 10 ohms, the supply voltage E2 is 200 V, a resistance of the resistor 2 is 500 ohms, and the potential Vg of an ark column generated between the electrode 10 and the workpiece W is 25 V, a peak value Ip of the discharge current pulse is represented by equation (3) below and found to be approximately 7.5 A.

$$Ip=(E1-Vg)/(R1+Re)+(E1+E2-Vg)/(R2+Re) \quad (3)$$

Therefore, in the fourth embodiment, although the voltage applied between the electrode 10 and the workpiece W is much larger at 300 V than that of the first embodiment at 100 V, it is possible to make the discharge current almost unchanged.

When the voltage applied is increased, the discharge occurs more easily and it is thus possible to perform the coating more stably. The distance between an electrode and a workpiece is usually controlled when a discharge occurs. Consequently, if a discharge is made to occur more easily, it is required to increase that distance. As a result, a material of the electrode tends to be more scattered around the workpiece during discharge, and the speed of coating tends to be thus somewhat reduced. Therefore, to keep the stability of the coating process, it may be necessary to decrease or increase the voltage applied between the electrode and the workpiece accordingly. If the supply voltage of the main power supply is changed without utilization of the auxiliary power supply used in the fourth embodiment, the discharge current is apt to change significantly. According to the fourth embodiment, it is possible to keep the discharge current pulse constant since only the voltage applied between the electrode and the workpiece can be independently chanted.

The discharge surface treatment realized by the configuration shown in FIG. 11 is substantially equivalent to that in FIG. 10 which is also equivalent to FIG. 1. The only difference is that in FIG. 11, the circuit for increasing the voltage between the electrode and the workpiece in the unloaded period is added without hardly changing the discharge current. The supply voltage E2 is negligible when detecting the occurrence of discharge because the actual power supply for the discharge treatment is the DC power supply 4 functioning as the main power supply. The supply voltage E2 hardly has any effect on the voltage detected by the detection means 7 during the discharge because the resistance of the resistor R2 is comparatively large.

Figure 12:
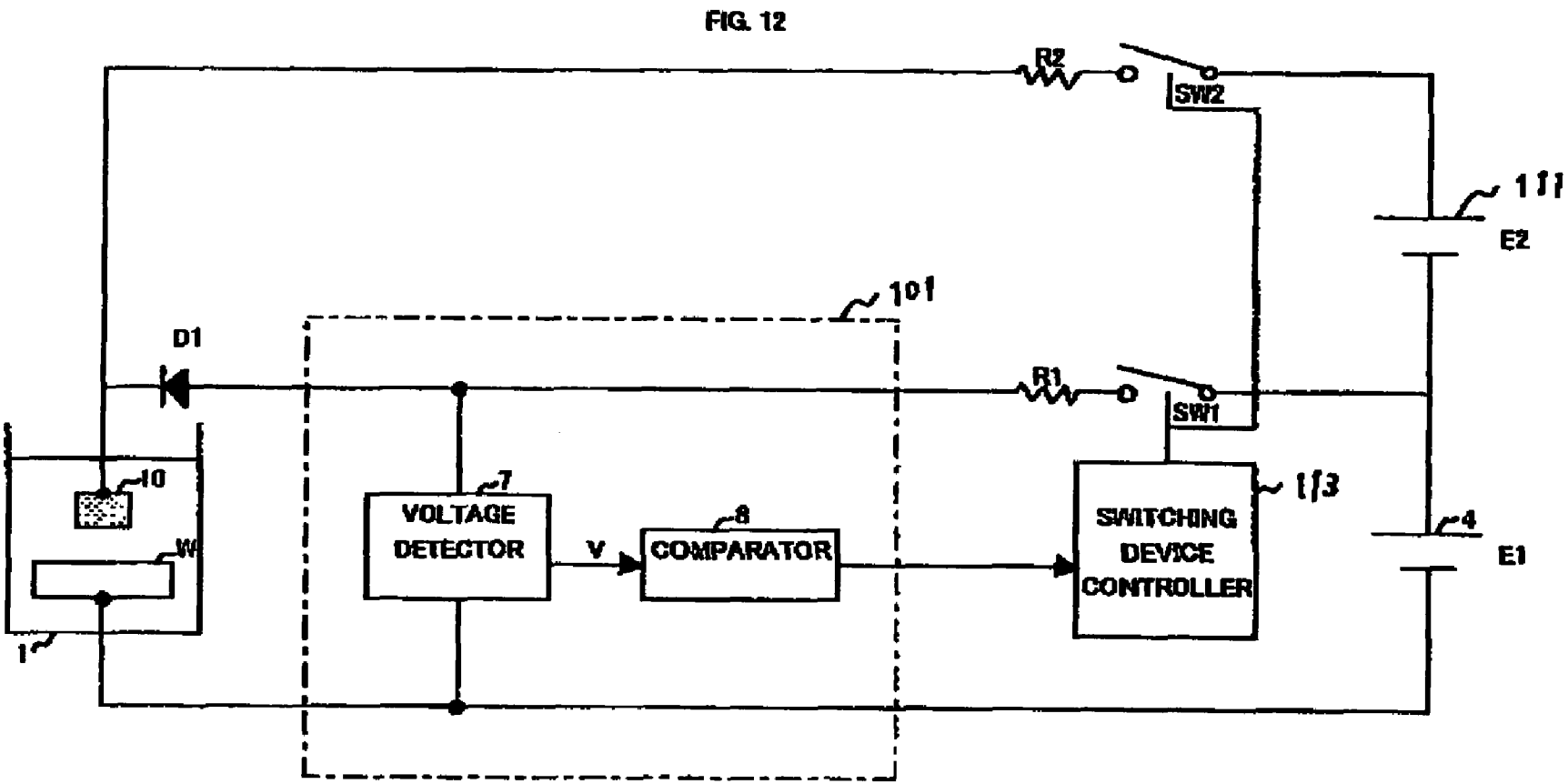
FIG. 12 is a block diagram of a modified example of the fourth embodiment.

FIG. 12 is a block diagram of a modified example of the fourth embodiment. As shown in FIG. 12, the voltage detection means 7 is connected to a terminal of the rectifier D1 which is opposite the terminal of the rectifier D1 in FIG. 11 connected to the voltage detection means 7 in FIG. 11. In other words, the rectifier D1 is located between the DC power supply 4 and the electrode 10, as well as between the voltage detection means 7 and the electrode 10. As a result, the supply voltage E2 of the DC power supply 111 as the auxiliary power supply is not applied to the voltage detection means 7. That is, in a similar manner to that in the first embodiment, the discharge detection voltage Vth is set to be a value which is less than the supply voltage E1 by an amount equivalent to 5% to 20% of the supply voltage E1.

In both FIGS. 11 and 12, if the switching element SW2 is turned OFF at the time the discharge starts to occur, it is possible to keep the current during the discharge even more constant.

Further, in FIGS. 11 and 12, the voltage between the electrode 10 and the workpiece W may be decreased even if a discharge is not occurring, when the impedance between the electrode 10 and the workpiece W is slightly reduced by contamination caused between the electrode 10 and the workpiece, because the DC power supply 111 is connected to the resistor R2 having an impedance greater than that of the resistor R1. Therefore, it is not desirable to set the discharge detection voltage Vth at a value greater than the supply voltage E1, as occurrence of discharge may be falsely detected.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An apparatus for discharge surface treatment, comprising:

a green compact electrode as a discharge electrode including a material of a coating formed on a surface of a workpiece by a discharge generated between the discharge electrode and the workpiece;

a first power source configured to supply a first voltage;

a voltage detector configured to detect a voltage between the workpiece and the discharge electrode; and a pulse current generator configured to generate and output a pulse current from the first voltage, and to cut off the output when a predetermined period of time has passed after the voltage detector detects the voltage to be less than a discharge detection voltage, wherein the pulse current output by the pulse current generator is supplied between the workpiece and the discharge electrode, and the discharge detection voltage is a value less than the first voltage by 5% to 20% of the first voltage.

2. The apparatus according to claim 1, wherein the pulse current generator comprises:

a resistor;

a switching element connected in series with the resistor; and a switching element controller configured to control the switching element in response to a detection signal output by the voltage detector.

3. The apparatus according to claim 1, further comprising:

a second power source configured to supply a second voltage during a period of time between a point of time at which the first voltage is started to be supplied and a point of time at which the discharge starts to occur, wherein the pulse current generator is configured to generate and output the pulse current from the first and second voltages.

4. The apparatus according to claim 3, wherein the pulse current is a sum of:

a first current generated based on the first voltage; and a second current generated based on the second voltage.

5. The apparatus according to claim 3, wherein the first voltage is less than the second voltage.

6. The apparatus according to claim 3, wherein the pulse current generator comprises:

a first resistor;

a first switching element connected in series with the first resistor; and a switching element controller configured to control the first switching element in response to a detection signal output by the voltage detector.

7. The apparatus according to claim 6, further comprising:

a second resistor and a second switching element which are connected in parallel with the first resistor and the first switching element and connected between the second power source and the discharge electrode, wherein the switching element controller is configured to control the first and second switching elements.

8. The apparatus according to claim 7, wherein a first resistance of the first resistor is less than a second resistance of the second resistor.

9. The apparatus according to claim 3, further comprising a rectifier connected to be located between the first power source and the discharge electrode.

10. The apparatus according to claim 9, wherein the rectifier is connected to be located further between the voltage detector and the discharge electrode.

* * * * *